US011289283B1

(12) United States Patent
Chang et al.

(10) Patent No.: US 11,289,283 B1
(45) Date of Patent: Mar. 29, 2022

(54) KEY STRUCTURE AND RUBBER DOME THEREOF

(71) Applicant: Primax Electronics Ltd., Taipei (TW)

(72) Inventors: Chia-Wei Chang, Taipei (TW); Chin-Sung Pan, Taipei (TW); Lei-Lung Tsai, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/137,476

(22) Filed: Dec. 30, 2020

(30) Foreign Application Priority Data

Oct. 30, 2020 (TW) ..... 109137944

(51) Int. Cl.
*H01H 13/14* (2006.01)
*H01H 13/52* (2006.01)

(52) U.S. Cl.
CPC ..... *H01H 13/14* (2013.01); *H01H 13/52* (2013.01); *H01H 2215/006* (2013.01); *H01H 2215/02* (2013.01); *H01H 2227/022* (2013.01); *H01H 2227/032* (2013.01)

(58) Field of Classification Search
CPC .. H01H 13/14; H01H 13/52; H01H 2215/006; H01H 2215/02
USPC ..... 200/5 A, 341
See application file for complete search history.

(56) References Cited

U.S. PATENT DOCUMENTS

2006/0081451 A1* 4/2006 Masuda ..... H01H 13/52 200/341
2011/0056818 A1* 3/2011 Maruyama ..... H01H 13/705 200/5 A
2012/0181155 A1* 7/2012 Iwamoto ..... H01H 3/125 200/341

* cited by examiner

*Primary Examiner* — Edwin A. Leon
*Assistant Examiner* — Iman Malakooti
(74) *Attorney, Agent, or Firm* — Kirton McConkie; Evan R. Witt

(57) ABSTRACT

A key structure includes a keycap, a membrane circuit board, and a rubber dome between the keycap and the membrane circuit board. The rubber dome includes a ring-shaped structure, a lower foundation structure, a contacting post, a first inclined wall and a second inclined wall. The ring-shaped structure includes a first top surface. The first top surface is upwardly pushed against the keycap. The lower foundation structure includes a first bottom surface. The first bottom surface is pushed downwardly pushed against the membrane circuit board. The contacting post is connected with the ring-shaped structure. The first inclined wall is connected with the ring-shaped structure and the lower foundation structure. The second inclined wall is connected with the ring-shaped structure and the contacting post. There is a first included angle θ1 between the second inclined wall and the first bottom surface. Preferably, 30°≤θ1≤85°.

12 Claims, 5 Drawing Sheets

KEY STRUCTURE AND RUBBER DOME THEREOF

FIELD OF THE INVENTION

The present invention relates to a rubber dome, and more particularly to a rubber dome that is installed in a key structure and a key structure with the rubber dome.

BACKGROUND OF THE INVENTION

Generally, a keyboard device comprises plural key structures. The key structure comprises a keycap, a rubber dome and a membrane circuit board (or a switching circuit board). The rubber dome is arranged between the keycap and the membrane circuit board. After the keycap is pressed down by the user, the rubber dome is subjected to deformation to trigger the membrane circuit board. Moreover, the keycap can be returned to its original position or restored to its original state with the assistance of the rubber dome. However, the design of the rubber dome still has some drawbacks. For example, when the key structure is pressed down and close to the bottom, an undesired stiff feedback occurs. That is, the tactile feel of depressing the key structure is not good enough.

Therefore, the conventional rubber dome needs to be further improved.

SUMMARY OF THE INVENTION

Generally, the tactile feel of a key structure is related to the design about the load collapse limit of the rubber dome. For enhancing the tactile feel of depressing the key structure, the present invention provides a novel rubber dome. The rubber dome is applied to a key structure. While the key structure is pressed down, the user may feel that the rubber dome generates two short supporting effects. Consequently, the tactile feel is generated twice. Due to the two-stage tactile feel design of the rubber dome, the force of the keycap to collide with the other components (e.g., a scissor-type connecting element or a frame) of the key structure is alleviated. Consequently, when the key structure is operated, the generated noise is reduced, and the key travel distance is extended.

In accordance with an embodiment of the present invention, a rubber dome is provided. The rubber dome is arranged between a keycap and a membrane circuit board. The rubber dome is moved downwardly to trigger the membrane circuit board in response to a pressing action on the keycap. The rubber dome includes a ring-shaped structure, a lower foundation structure, a contacting post, a first inclined wall and a second inclined wall. The ring-shaped structure includes a first top surface and a first hollow portion. The first top surface is upwardly pushed against the keycap. The lower foundation structure includes a first bottom surface and a second hollow portion. The first bottom surface is pushed downwardly pushed against the membrane circuit board. The contacting post is connected with the ring-shaped structure. The first inclined wall is connected with the ring-shaped structure and the lower foundation structure. The second inclined wall is connected with the ring-shaped structure and the contacting post. There is a first included angle $\theta 1$ between the second inclined wall and the first bottom surface. Preferably, $30° \leq \theta 1 \leq 85°$.

In an embodiment, the contacting post includes a second top surface and a second bottom surface.

While the key structure is pressed down and the moved downwardly, the second bottom surface of the contacting post is penetrated through the second hollow portion and downwardly pushed against the membrane circuit board, and then the second top surface of the contacting post is penetrated through the first hollow portion and upwardly pushed against the keycap.

While the second bottom surface of the contacting post is penetrated through the second hollow portion and downwardly pushed against the membrane circuit board, the first inclined wall is subjected to distortion and a first pause feel is generated. While the second top surface of the contacting post is penetrated through the first hollow portion and upwardly pushed against the keycap, the second inclined wall is subjected to distortion and a second pause feel is generated.

In an embodiment, the contacting post further includes a wall part. The wall part is connected with the second top surface and the second bottom surface. The second inclined wall is connected with the wall part of the contacting post.

In an embodiment, a thickness of the first inclined wall is larger than a thickness of the second inclined wall.

In an embodiment, the second inclined wall is a two-segment structure including an inclines segment and a horizontal segment.

In an embodiment, there is a second included angle between the first inclined wall and the first bottom surface of the lower foundation structure. The first included angle is larger than the second included angle.

In an embodiment, $60° \leq \theta 1 \leq 80°$.

In accordance with an embodiment of the present invention, a key structure is provided. The key structure includes a keycap, a membrane circuit board and a rubber dome. The rubber dome is arranged between the keycap and the membrane circuit board. The rubber dome is moved downwardly to trigger the membrane circuit board in response to a pressing action on the keycap. The rubber dome includes a ring-shaped structure, a lower foundation structure, a contacting post, a first inclined wall and a second inclined wall. The ring-shaped structure includes a first top surface and a first hollow portion. The first top surface is upwardly pushed against the keycap. The lower foundation structure includes a first bottom surface and a second hollow portion. The first bottom surface is pushed downwardly pushed against the membrane circuit board. The contacting post is connected with the ring-shaped structure. The first inclined wall is connected with the ring-shaped structure and the lower foundation structure. The second inclined wall is connected with the ring-shaped structure and the contacting post. There is a first included angle $\theta 1$ between the second inclined wall and the first bottom surface. Preferably, $30° \leq \theta 1 \leq 85°$.

In an embodiment, the contacting post includes a second top surface and a second bottom surface.

While the key structure is pressed down and the moved downwardly, the second bottom surface of the contacting post is penetrated through the second hollow portion and downwardly pushed against the membrane circuit board, and then the second top surface of the contacting post is penetrated through the first hollow portion and upwardly pushed against the keycap.

While the second bottom surface of the contacting post is penetrated through the second hollow portion and downwardly pushed against the membrane circuit board, the first inclined wall is subjected to distortion and a first pause feel is generated. While the second top surface of the contacting post is penetrated through the first hollow portion and upwardly pushed against the keycap, the second inclined wall is subjected to distortion and a second pause feel is generated.

In an embodiment, the contacting post further includes a wall part. The wall part is connected with the second top surface and the second bottom surface. The second inclined wall is connected with the wall part of the contacting post.

In an embodiment, a thickness of the first inclined wall is larger than a thickness of the second inclined wall.

In an embodiment, the second inclined wall is a two-segment structure including an inclines segment and a horizontal segment.

In an embodiment, there is a second included angle between the first inclined wall and the first bottom surface of the lower foundation structure. The first included angle is larger than the second included angle.

In an embodiment, $60° \leq \theta 1 \leq 80°$.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. In the following embodiments and drawings, the elements irrelevant to the concepts of the present invention are omitted and not shown.

Figure 1:
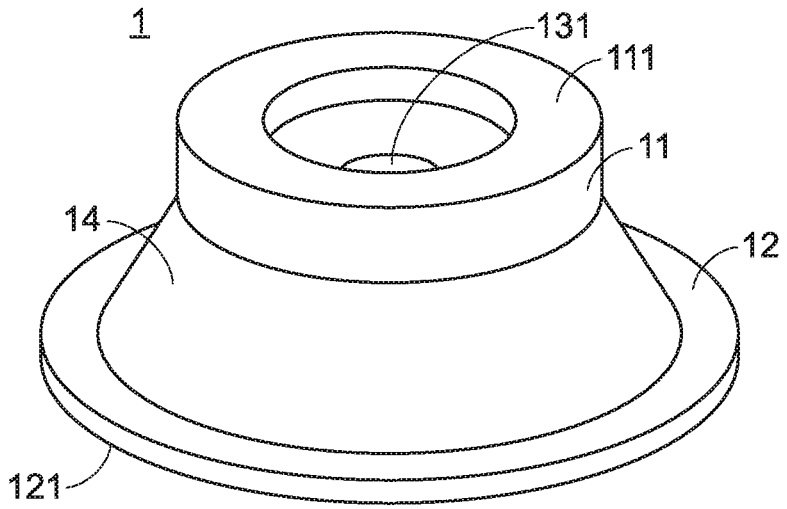
FIG. 1 is a schematic perspective view illustrating a rubber dome according to a first embodiment of the present invention.
Figure 2A:
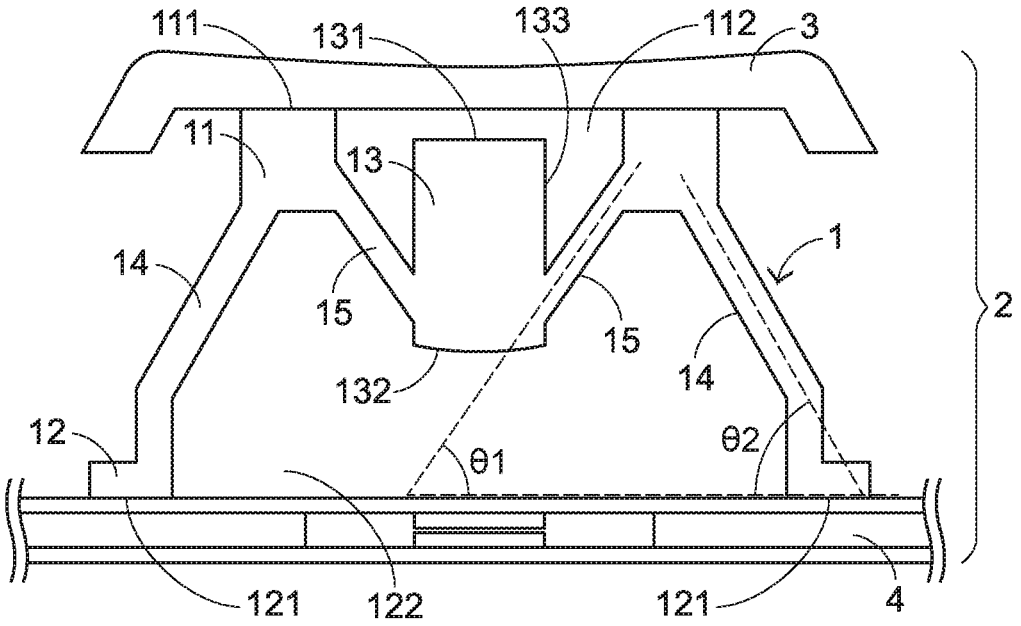
FIG. 2A is a schematic cross-sectional view illustrating the installation of the rubber dome in a key structure and the arrangement of the rubber dome between a keycap and a membrane circuit board according to the first embodiment of the present invention.

Please refer to FIG. 1 and FIG. 2A. FIG. 1 is a schematic perspective view illustrating a rubber dome according to a first embodiment of the present invention. FIG. 2A is a schematic cross-sectional view illustrating the installation of the rubber dome in a key structure and the arrangement of the rubber dome between a keycap and a membrane circuit board. The present invention provides a rubber dome 1. The rubber dome 1 is installed in a key structure 2. In addition, the rubber dome 1 is arranged between a keycap 3 and a membrane circuit board 4 of the key structure 2.

In an embodiment, the rubber dome 1 comprises a ring-shaped structure 11, a lower foundation structure 12, a contacting post 13, a first inclined wall 14 and a second inclined wall 15. The ring-shaped structure 11 of the rubber dome 1 comprises a first top surface 111 and a first hollow portion 112. When the rubber dome 1 is disposed within the key structure 2, the first top surface 111 is upwardly pushed against the keycap 3. The lower foundation structure 12 of the rubber dome 1 comprises a first bottom surface 121 and a second hollow portion 122. When the rubber dome 1 is disposed within the key structure 2, the first bottom surface 121 is pushed downwardly pushed against the membrane circuit board 4. Moreover, the ring-shaped structure 11 and the lower foundation structure 12 are connected with each other through the first inclined wall 14.

The contacting post 13 is disposed within the rubber dome 1. The contacting post 13 is connected with the ring-shaped structure 11 through the second inclined wall 15. The contacting post 13 comprises a second top surface 131, a second bottom surface 132 and a wall part 133. The wall part 133 is connected with the second top surface 131 and the second bottom surface 132. Particularly, the second inclined wall 15 is connected with the ring-shaped structure 11 and the wall part 133 of the contacting post 13.

Figure 2B:
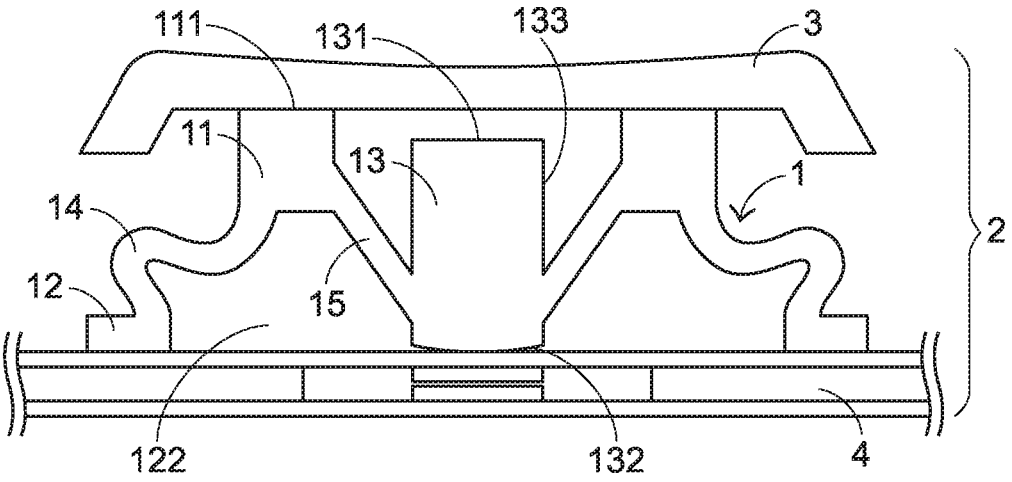
FIG. 2B is a schematic cross-sectional view illustrating that the second bottom surface of the contacting post is penetrated through the second hollow portion of the lower foundation structure and downwardly pushed against the membrane circuit board according to the first embodiment of the present invention.
Figure 3:
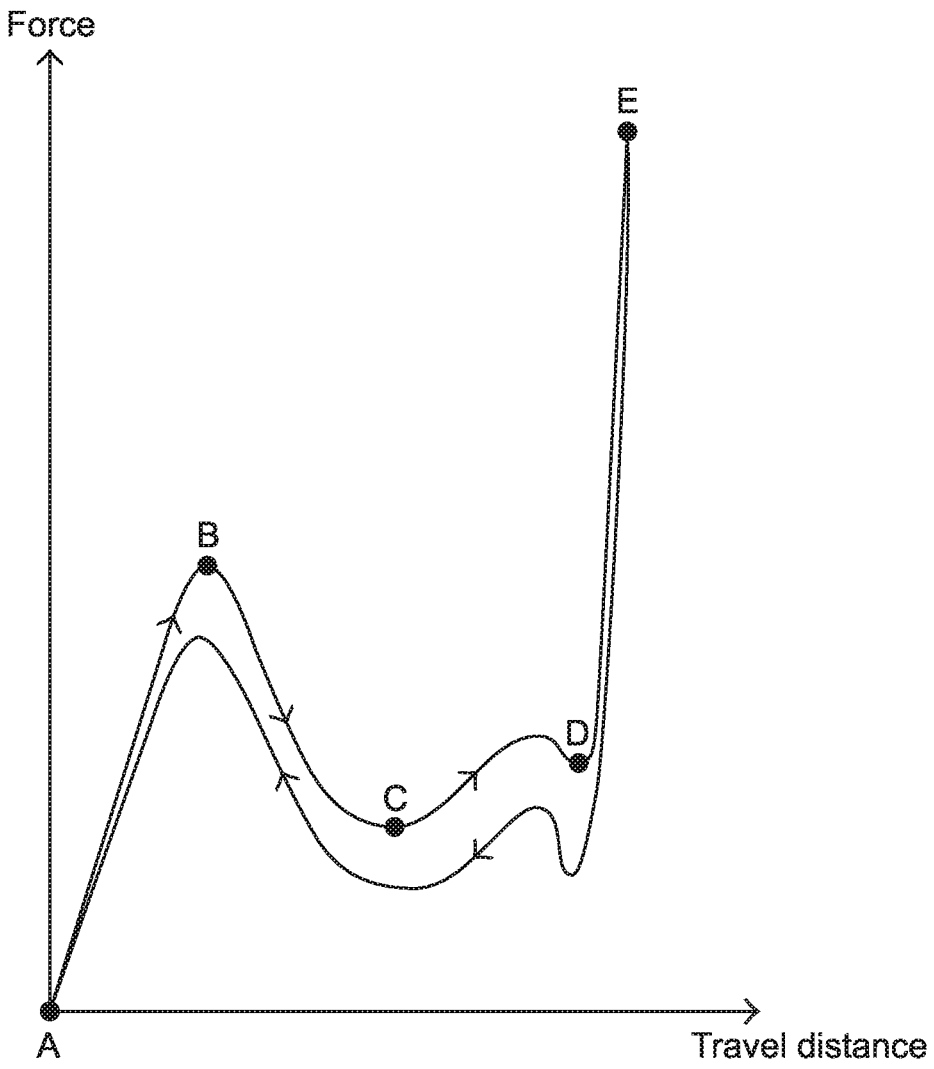
FIG. 3 is a plot illustrating the relationship between the force of pressing the key structure and the travel distance.

Please refer to FIG. 2A, FIG. 2B and FIG. 3. FIG. 3 is a plot illustrating the relationship between the force of pressing the key structure and the travel distance. In FIG. 3, the horizontal axis denotes the travel distance (i.e., the movable distance of pressing down the key structure), and the vertical axis denotes the force (i.e., the required magnitude of the force to press down the key structure).

While the key structure 3 is pressed down by the user, the rubber dome 1 is moved downwardly and the first inclined wall 14 is subjected to deformation and distortion. That is, the situation of FIG. 2A is switched to the situation of FIG. 2B. Then, the second bottom surface 132 of the contacting post 13 is penetrated through the second hollow portion 122 of the lower foundation structure 12. When the second bottom surface 132 of the contacting post 13 is contacted with the membrane circuit board 4, the membrane circuit board 4 is triggered to generate a signal. The above process is correlated to the force-travel distance diagram of FIG. 3. Firstly, the travel distance is started from the point A at the time when the rubber dome 1 is pressed down by the user through the keycap 3. As the travel distance is gradually increased, the resistance of the rubber dome 1 is gradually increased. At the point B of the travel distance, the deformation and distortion of the first inclined wall 14 results in the collapse of the rubber dome 1. Consequently, the force of pressing the key structure is gradually decreased. At the point C of the travel distance, the second bottom surface 132 of the contacting post 13 is contacted with the membrane circuit board 4. Consequently, the resistance of the rubber dome 1 is gradually increased. As shown in the force-travel distance diagram of FIG. 3, a first wave is generated along the path from the point A to the point C. That is, a first stage of the tactile feel curve is generated. During this pressing process, the user can feel the pause feel for the first time.

Figure 2C:
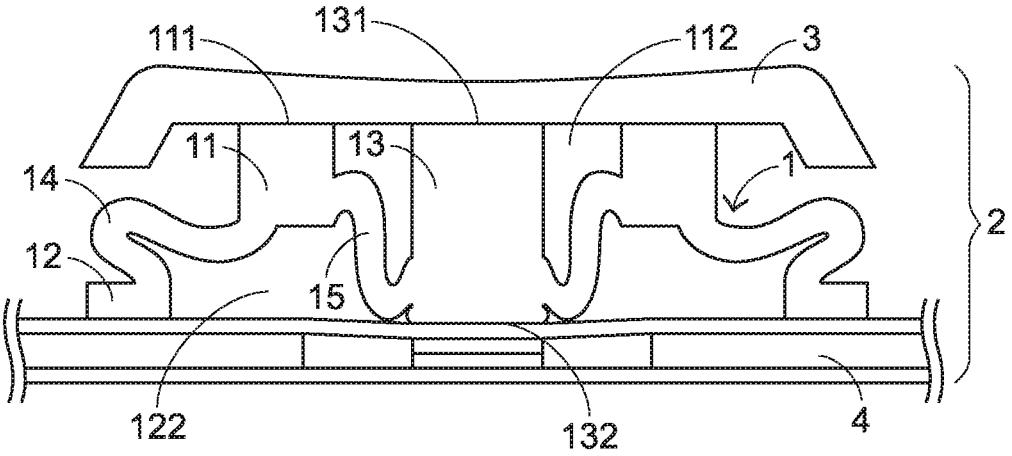
FIG. 2C is a schematic cross-sectional view illustrating that the second top surface of the contacting post is penetrated through the first hollow portion and upwardly pushed against the keycap according to the first embodiment of the present invention.

Please refer to FIG. 2B, FIG. 2C and FIG. 3. After the second bottom surface 132 of the contacting post 13 is contacted with the membrane circuit board 4, the second inclined wall 15 is subjected to deformation and distortion. That is, the situation of FIG. 2B is switched to the situation of FIG. 2C. Then, the second top surface 131 of the contacting post 13 is penetrated through the first hollow portion 112 and upwardly pushed against the keycap 4. When the degree of the deformation and distortion of the second inclined wall 15 reaches a certain level, the rubber dome 1 collapses and there is a certain distance between the second top surface 131 of the contacting post 13 and the keycap 3. Consequently, after the contacting post 13 is moved downwardly to trigger the membrane circuit board 4, an additional stage of the travel distance occurs. In other words, the second inclined wall 15 has a space for generating deformation, distortion and collapse. The above process is correlated to the force-travel distance diagram of FIG. 3. After the second bottom surface 132 of the contacting post 13 is contacted with the membrane circuit board 4, the keycap 3 is continuously pressed down to push the rubber dome 1. As shown in the force-travel distance diagram of FIG. 3, the travel distance is moved from the point C to the point D, and the force is gradually increased. Since the deformation, distortion and collapse of the second inclined wall 15 occur, a second wave is generated along the path from the point C to the point D. That is, a second stage of the tactile feel curve is generated. During this pressing process, the user can feel the pause feel for the second time.

In the pressing process from the point D to the point E, the travel distance is very short. Consequently, the resistance of the rubber dome 1 becomes very large. When the external force applied to the keycap 3 starts to be released, the force on the rubber dome 1 is released. Then, the second inclined wall 15 is restored to its original shape. Afterwards, the first inclined wall 14 is restored to its original shape. The above releasing process is correlated to the force-travel distance diagram of FIG. 3 along the path from the point E back to the point A.

For providing the pause feel twice in response to the depressing action on the key structure and extending the travel distance, the rubber dome installed in the key structure needs to be specially designed. In this embodiment, the ring-shaped structure 11 and the contacting post 13 are connected with each other through the second inclined wall 15, and there is a first included angle θ1 between the second inclined wall 15 and the first bottom surface 121 of the lower foundation structure 12. Moreover, $30° \leq \theta 1 \leq 85°$, and preferably $60° \leq \theta 1 \leq 80°$. Due to the steep angle of the second inclined wall 15, the rubber dome 1 collapses when the degree of the deformation and distortion of the second inclined wall 15 reaches a certain level. Consequently, the operation of the key structure can provide the pause feel twice.

As shown in FIG. 2A, there is the first included angle θ1 between the second inclined wall 15 and the first bottom surface 121 of the lower foundation structure 12. Moreover, there is a second included angle θ2 between the first inclined wall 14 and the first bottom surface 121 of the lower foundation structure 12. For providing the pause feel twice, the first included angle θ1 is larger than the second included angle θ2. This design is helpful for generating the deformation and distortion of the second inclined wall until collapse.

For providing the pause feel twice in response to the depressing action on the key structure, the rubber dome may have another feature. As shown in FIG. 2A, the thickness of the first inclined wall 14 is larger than the thickness of the second inclined wall 15. This design is helpful for generating the deformation and distortion of the second inclined wall until collapse.

Figure 4A:
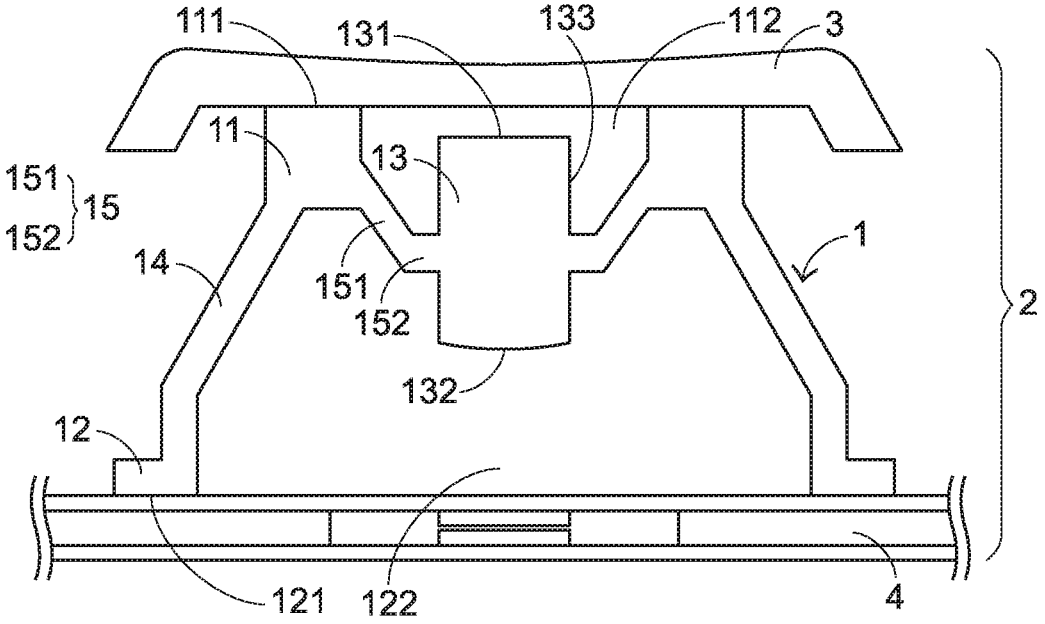
FIG. 4A is a schematic cross-sectional view illustrating the installation of the rubber dome in a key structure and the arrangement of the rubber dome between a keycap and a membrane circuit board according to a second embodiment of the present invention.
Figure 4B:
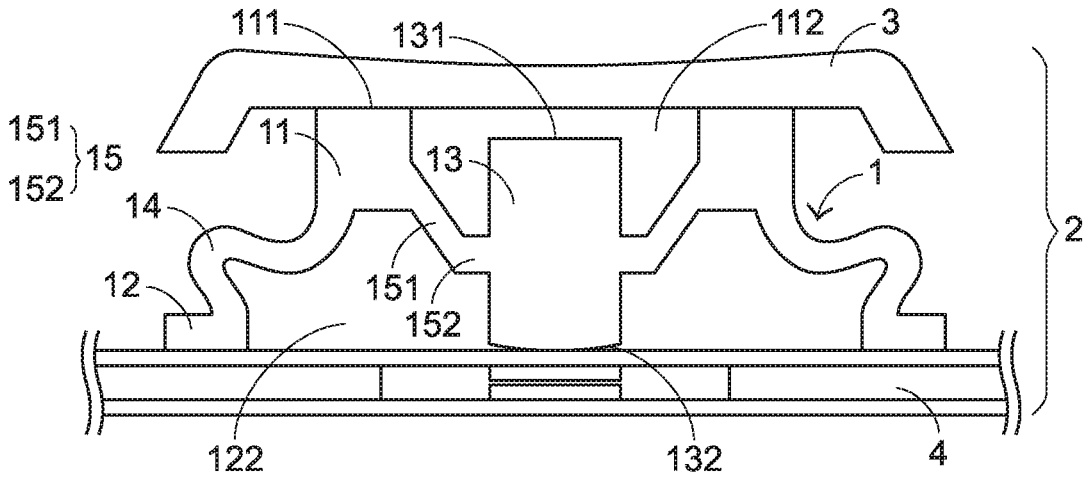
FIG. 4B is a schematic cross-sectional view illustrating that the second bottom surface of the contacting post is penetrated through the second hollow portion of the lower foundation structure and downwardly pushed against the membrane circuit board according to the second embodiment of the present invention.

FIGS. 4A, 4B and 4B are schematic cross-sectional views illustrating the installation of the rubber dome in a key structure and the process of triggering the membrane circuit board in response to the pressing action of the key structure according to a second embodiment of the present invention. In comparison with the rubber dome of the first embodiment, the design of the second inclined wall 15 in the rubber dome 1 of this embodiment is distinguished. In this embodiment, the second inclined wall 15 in the rubber dome 1 of this embodiment second inclined wall 15 in the rubber dome 1 of this embodiment has a two-segment structure. As shown in FIG. 4A, the second inclined wall 15 comprises an inclines segment 151 and a horizontal segment 152.

Figure 4C:
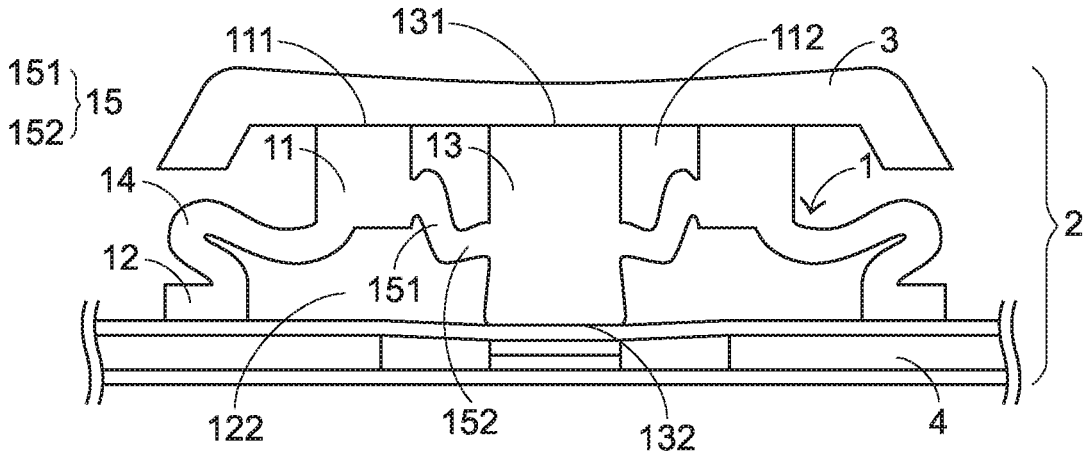
FIG. 4C is a schematic cross-sectional view illustrating that the second top surface of the contacting post is penetrated through the first hollow portion and upwardly pushed against the keycap according to the second embodiment of the present invention.

While the key structure 3 is pressed down by the user, the rubber dome 1 is moved downwardly. That is, the situation of FIG. 4A is switched to the situation of FIG. 4B. Then, the second bottom surface 132 of the contacting post 13 is penetrated through the second hollow portion 122 of the lower foundation structure 12. When the second bottom surface 132 of the contacting post 13 is contacted with the membrane circuit board 4, the membrane circuit board 4 is triggered to generate a signal. During this pressing process, the first inclined wall 14 is also subjected to deformation, distortion and collapse. Consequently, the user can feel the pause feel for the first time. After the second bottom surface 132 of the contacting post 13 is contacted with the membrane circuit board 4, the situation of FIG. 4B is switched to the situation of FIG. 4C. Then, the second top surface 131 of the contacting post 13 is penetrated through the first hollow portion 112 and upwardly pushed against the keycap 4. During this pressing process, the second inclined wall 15 connected between the ring-shaped structure 11 and the contacting post 13 is also subjected to deformation and distortion until collapse. Consequently, the user can feel the pause feel for the second time.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A rubber dome arranged between a keycap and a membrane circuit board, the rubber dome being moved downwardly to trigger the membrane circuit board in response to a pressing action on the keycap, the rubber dome comprising:

a ring-shaped structure comprising a first top surface and a first hollow portion, wherein the first top surface is upwardly pushed against the keycap;

a lower foundation structure comprising a first bottom surface and a second hollow portion, wherein the first bottom surface is pushed downwardly pushed against the membrane circuit board;

a contacting post connected with the ring-shaped structure, wherein the contacting post comprises a second top surface extended into the first hollow portion and a second bottom surface;

a first inclined wall connected with the ring-shaped structure and the lower foundation structure; and a second inclined wall connected with the ring-shaped structure and the contacting post, wherein there is a first included angle θ1 between the second inclined wall and the first bottom surface, and 30°≤θ1≤85°, wherein while the key structure is pressed down and the moved downwardly, the second bottom surface of the contacting post is penetrated through the second hollow portion and downwardly pushed against the membrane circuit board, and then the second top surface of the contacting post is penetrated through the first hollow portion and upwardly pushed against the keycap, and wherein while the second bottom surface of the contacting post is penetrated through the second hollow portion and downwardly pushed against the membrane circuit board, the first inclined wall is subjected to distortion and a first pause feel is generated, wherein while the second top surface of the contacting post is penetrated through the first hollow portion and upwardly pushed against the keycap, the second inclined wall is subjected to distortion and a second pause feel is generated.

2. The rubber dome according to claim 1, wherein the contacting post further comprises a wall part, wherein the wall part is connected with the second top surface and the second bottom surface, and the second inclined wall is connected with the wall part of the contacting post.

3. The rubber dome according to claim 1, wherein a thickness of the first inclined wall is larger than a thickness of the second inclined wall.

4. The rubber dome according to claim 1, wherein the second inclined wall is a two-segment structure comprising an inclined segment and a horizontal segment.

5. The rubber dome according to claim 1, wherein there is a second included angle between the first inclined wall and the first bottom surface of the lower foundation structure, wherein the first included angle is larger than the second included angle.

6. The rubber dome according to claim 1, wherein 60°≤θ1≤80°.

7. A key structure, comprising:

a keycap;

a membrane circuit board; and a rubber dome arranged between the keycap and the membrane circuit board, wherein the rubber dome is moved downwardly to trigger the membrane circuit board in response to a pressing action on the keycap, and the rubber dome comprises:

a ring-shaped structure comprising a first top surface and a first hollow portion, wherein the first top surface is upwardly pushed against the keycap;

a lower foundation structure comprising a first bottom surface and a second hollow portion, wherein the first bottom surface is pushed downwardly pushed against the membrane circuit board;

a contacting post connected with the ring-shaped structure, wherein the contacting post comprises a second top surface extended into the first hollow portion and a second bottom surface;

a first inclined wall connected with the ring-shaped structure and the lower foundation structure; and a second inclined wall connected with the ring-shaped structure and the contacting post, wherein there is a first included angle θ1 between the second inclined wall and the first bottom surface, and 30°≤θ1≤85°, wherein while the key structure is pressed down and the moved downwardly, the second bottom surface of the contacting post is penetrated through the second hollow portion and downwardly pushed against the membrane circuit board, and then the second top surface of the contacting post is penetrated through the first hollow portion and upwardly pushed against the keycap, and wherein while the second bottom surface of the contacting post is penetrated through the second hollow portion and downwardly pushed against the membrane circuit board, the first inclined wall is subjected to distortion and a first pause feel is generated, wherein while the second top surface of the contacting post is penetrated through the first hollow portion and upwardly pushed against the keycap, the second inclined wall is subjected to distortion and a second pause feel is generated.

8. The key structure according to claim 7, wherein the contacting post further comprises a wall part, wherein the wall part is connected with the second top surface and the second bottom surface, and the second inclined wall is connected with the wall part of the contacting post.

9. The key structure according to claim 7, wherein a thickness of the first inclined wall is larger than a thickness of the second inclined wall.

10. The key structure according to claim 7, wherein the second inclined wall is a two-segment structure comprising an inclined segment and a horizontal segment.

11. The key structure according to claim 7, wherein there is a second included angle between the first inclined wall and the first bottom surface of the lower foundation structure, wherein the first included angle is larger than the second included angle.

12. The key structure according to claim 7, wherein 60°≤θ1≤80°.

* * * * *